US005224985A

United States Patent [19]

Kullik et al.

[11] Patent Number: 5,224,985

[45] Date of Patent: Jul. 6, 1993

[54] PROCESS AND APPARATUS FOR THE MELTING OF METALS IN THE CUPOLA FURNACE OPERATED WITHOUT COKE

[75] Inventors: Wolfgang Kullik, Amorbach; Rainer Graf, Hösbach-Winzehohl; Alfred Langner, Walldürn-Rippberg, all of Fed. Rep. of Germany

[73] Assignee: La Bonvarite S.A.R.L., Comines, France

[21] Appl. No.: 646,608

[22] PCT Filed: May 11, 1990

[86] PCT No.: PCT/DE90/00344

§ 371 Date: Jan. 16, 1991

§ 102(e) Date: Jan. 16, 1991

[87] PCT Pub. No.: WO90/14568

PCT Pub. Date: Nov. 29, 1990

[30] Foreign Application Priority Data

Aug. 20, 1989 [DE] Fed. Rep. of Germany .... P3916503

[51] Int. Cl.[5] ..... C21C 1/08

[52] U.S. Cl. ..... 75/574; 266/225; 266/900; 420/29

[58] Field of Search ..... 266/216, 217, 225, 80, 266/900, 225, 900; 75/574, 573, 575, 576, 577, 578, 579; 420/29

[56] References Cited

U.S. PATENT DOCUMENTS 3,424,573 1/1969 DeVilliers ..... 75/575
3,802,678 4/1974 Taft et al. ..... 75/574
3,928,022 12/1975 Langagne ..... 75/575

FOREIGN PATENT DOCUMENTS 1310773 5/1987 U.S.S.R. ..... 266/200

*Primary Examiner*—Melvyn J. Andrews
*Attorney, Agent, or Firm*—Michael J. Striker

[57] ABSTRACT

The improved method of melting a metal, especially cast iron, in a cokeless cupola furnace includes the step of injecting at least one case product quality improving and stabilizing substance into a space between the grate and the burners. The quality improving and stabilizing substance can be refining substance and a nuclear-enriching substance of the type used in code-fired cupola furnaces including nitrogen-containing substances such as ammonia and hydrazine and halogen-containing substances. A suitable apparatus for performing the improved process is also described having a downwardly direct lance for injection of the quality improving and stabilizing substance with an upwardly-directed mouth portion for forming an upwardly directed jet inserted through a furnace wall in a throughgoing guideway.

14 Claims, 1 Drawing Sheet

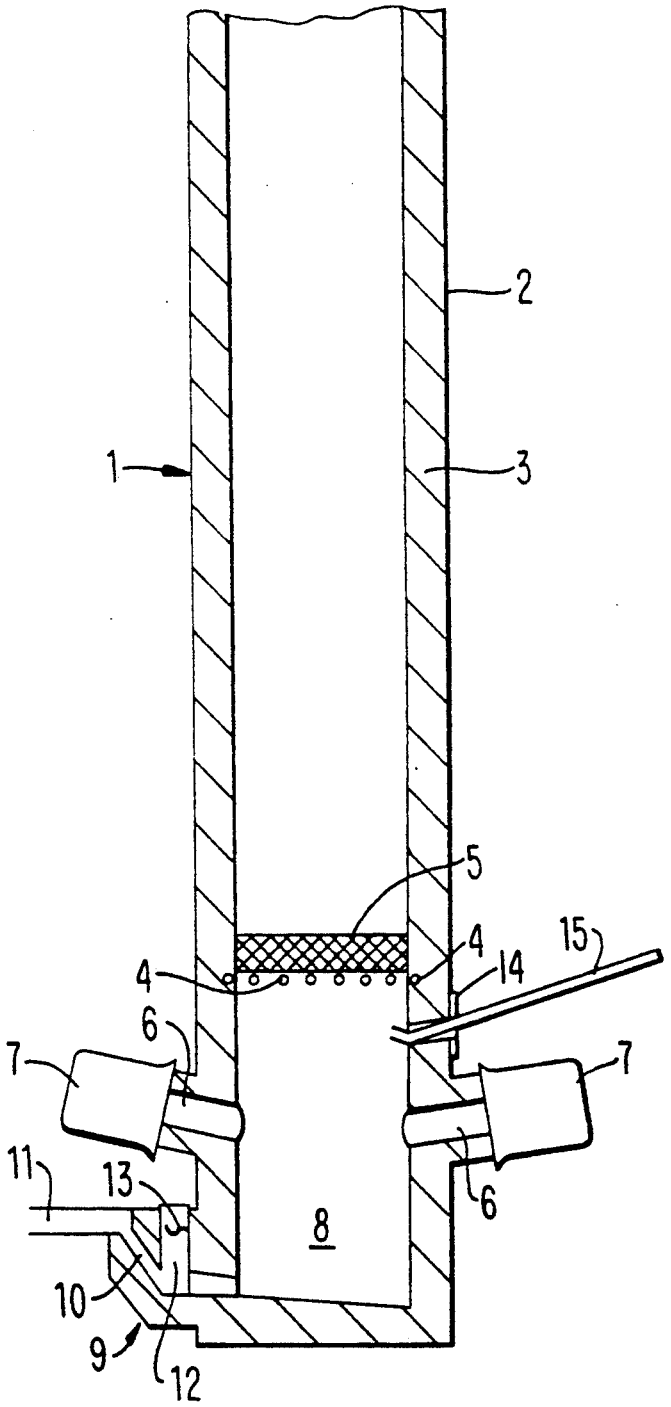
2
1
3
5
4
4
15
14
6
7
7
11
13
6
8
10
9
12

PROCESS AND APPARATUS FOR THE MELTING OF METALS IN THE CUPOLA FURNACE OPERATED WITHOUT COKE

BACKGROUND OF THE INVENTION

The invention relates to a method of melting a metal especially cast iron, in cupola furnaces operated without coke and an apparatus for carrying out the method. A known cupola furnace operated without coke has a vertically upright casing which is lined internally with a lining of refractory material and contains in its lower part a grate which is provided with a bed of loose-packed refractory bodies, and burners are arranged below the grate and at a distance from it.

Cupola furnaces operated without coke for the melting of metals have been known for decades (DE-B-11 02 977; DE-B-12 43 826; "Giesserei", Volume 74, no. 17, Aug. 17, 1987, pages 493 to 497), the energy required for the melting is produced chiefly with gaseous or liquid fuels. This has numerous advantages compared with the coke firing of cupola furnaces.

As a result of the omission of bed coke and charge coke, a better furnace charge is obtained and work with the slag is considerably facilitated. Temperature control in the furnace can be simpler, that is more rapid and more accurate. Dust removal from and cleaning of the exhaust gases, which with coke-fired furnaces require a large expenditure on apparatus and operation, are reduced to a small amount. The difficulties which occur with the coke-fired furnace because of the sulphur content of the coke, do not exist. Furthermore the thermal efficiency, which for coke-fired cupola furnaces is about 30%, is considerably greater, at up to 70 to 75%. Although processes for cokeless melting have been part of the prior art for a long time and should preferably be used because of continually growing environmental awareness, the ever stricter conditions relating to this and also for reasons of efficient production, it has not previously been possible to develop them to the extent that they satisfy the requirements for foundry products which are customary today. Satisfactory results with regard to reproducible and constant quality characteristics of the melt product have not been achievable hitherto.

An improvement of the process technology or a removal of the known disadvantages of cupola furnaces operated without coke have hitherto only been sought in the field of apparatus, thus, for example, by downstream core-type induction furnaces (DE-A-32 21 241) or by a widening of the furnace hearth with bevelling for enlargement of the radiating surface (DE-B-37 42 349) or by leading the fuel gas through lines laid in heated parts of the furnace lining (DE-B-15 83 279).

The known efforts with the object of process and product optimization led finally only to apparatus measures, with the result of improved energy use of the fuels, but not to a guarantee of a constant melt product with constant quality characteristics. In particular, neither a uniform form of graphite, preferably as A-graphite, nor a homogeneous metal structure has been achieved.

The above cited examples of the prior art show a lively endeavour, but it has never been attempted to solve the existing problems by process changes, for example, by treating the melt directly and early with agents which are used in the cupola furnace itself during the liquefaction processes and before the run-off or before the collection of the molten material in the furnace hearth. Such quality-improving measures are part of the prior art of the coke-fired cupola furnace, for which, to be sure, quite different conditions exist with regard to process engineering, chemistry and metallurgy.

Thus in FR-A-1 226 487 and DE-C-23 29 772 processes are described for exclusively coke-fired cupola furnaces, according to which on the one hand quality improvements and on the other hand the stabilization of desired quality standards are achieved by injecting specific substances into the cupola furnace in the region of the melt zone, that is to say in the zone of the furnace in which the metal melts on the glowing coke and runs off. Regarding this, a process is described in the above cited DE-C-23 29 772 for refining, for nitrogenizing, and for carburization or decarburization, whose use enables defined cast grades to be melted by corrective additives in the form of chemical substances. Serving as such additives are inter alia nitrogen- and/or halogen-releasing compounds in liquid or gaseous form and also, in case carburization is desired, compounds from the distillation of products of vegetable origin and, in case decarburization is desired, such compounds as release oxygen at melt temperature.

By contrast, it has never been attempted to use such a mode of operation also for the cupola furnace operated without coke. Such an idea was in fact opposed among other things because the melt zone, which certainly lies only above the bed of refractory bodies resting on the grate, is much too small in height (about 16 cm) for the added substances to be able to exhibit their effect. For the known processes it has always been emphasized that the added substances must react in the melt flowing off on the glowing coke, and therefore immediately after the liquefaction of the metal.

SUMMARY

The object of the invention is a method of melting of metals in a cupola furnace operated without coke and an apparatus for carrying out the method, by use of which a constant melt product and constant quality standard of the product, especially a uniform crystal structure and a defined form of graphite, are achieved. According to the invention, at least one cast product quality improving and stabilizing substance, especially a substance which produces a constant melt product of constant quality, is injected into a space between the grate on which the refractory bodies sit and the burners. These injected substances can include nitrogen-containing and halogen-containing substances previously used in coke-fired cupola furnaces.

It has surprisingly been found that excellent results are obtained from cupola furnaces operated without coke if—in contrast to the known process for the coke-fired cupola furnace—the substances are not injected into the melt zone, but into the space between the burners and the grate provided with the bed of refractory bodies. In general, the melting process is started with observance of all conditions usual with conventional melting, and the substances provided for are fed simultaneously.

It could not have been expected that with the short time of action of the substances on the drops of melt falling off the grate the same results could be possible as with the feeding of the substances into the melt flowing off the glowing coke, as is usual in the prior art. One was also prevented from assuming that the teaching given according to the invention could be successful, because of the surface tension of the free-falling drops.

In addition, the temperature of the accumulated melt in the cupola furnace operated without coke is about 200° C. lower than in the coke-fired cupola furnace. This means that the higher temperatures favoring the chemical reactions are not available in the cokeless cupola furnace.

It is also surprising that according to the invention one can make-do with about half the amount of additives per ton of metal in the cupola furnace operated without coke, that is with 1 to 2 liters per ton, compared with the known process on the coke-fired cupola furnace.

The substances to be added can serve for refining and/or for nucleus enrichment. Such substances can be the same as disclosed in the above described DE-C-23 29 772, and in particular nitrogen-releasing compounds, hydrogen compounds of nitrogen, such as ammonia or hydrazine or their derivatives and also organic nitro compounds, such as nitrobenzene; halogen-releasing compounds, such as methyl chloride, chlorobenzene or fluorobenzene; halogen- and nitrogen-releasing compounds in the form of monochlorinated and nitrated organic compounds.

Advantageously those of the substances mentioned which tend to coke by the action of heat are injected as solution, that is in a solvent preventing the coking. Suitable solvents are for example cyclohexane, toluene or xylene, and also chlorinated solvents which release chlorine at melt temperature.

According to the invention there is reliably obtained, for example, a grey cast iron of reduced section sensitivity and perlitic structure and with a predominant graphite form of the type A.

BRIEF DESCRIPTION OF THE DRAWING

The objects, features and advantages of the present invention will now be illustrated in more detail by the following detailed description, reference being made to the accompanying drawing in which:

The sole figure is a partial cross-sectional view of a cokeless cupola furnace according to the invention, with means for injecting a cast product quality improving and stabilizing substance.

DETAILED DESCRIPTION OF THE INVENTION

The cupola furnace 1 has a vertically upright cylindrical casing 2, which is lined inside with a lining 3 of refractory material. In the lower zone of the cupola furnace 1 there is situated the grate 4, on which is packed a bed 5 of refractory bodies. Above this bed 5 the cupola furnace 1 is charged with the material to be melted.

The bottom end of the cupola furnace 1 is designed as collecting space 8 for the melt. A laterally attached syphon 9 leads by a riser 10 to the discharge runner 11; a downcomer 12 is connected to the slag offtake 13.

The burners 7 with their flame bafflings 6 are arranged in a radial plane at a predetermined (for example of about 90 cm for a given furnace diameter of 130 cm) below the grate 4. Several burners 7 are necessary for good and uniform heating. The number of burners 7 depends on the furnace diameter. The burners 7 are distributed uniformly round the furnace circumference. According to the invention at least one lance 15 is inserted through a guideway 14 in the furnace wall into the space between the grate 4 and the burners 7. The lance 15 serves for the injection of the quality-improving substances. The lance tip ends at the internal wall of the furnace. A lance 15 is preferably directed obliquely downwards and its mouth portion 15' is formed, e.g. like a nozzle, and upwardly turned so that the emerging jet is directed upwards towards the grate 4. A preferred orientation of the lance 15, directed obliquely downwards, must be chosen if the lance 15 is provided with water cooling by arranging, between the jacket of the lance 15 and an injection tube for the substances to be added led centrally through the lance 15, a tube, open at its lower end, for the delivery of cooling liquid. The cooling liquid is led under pressure into the jacket of the lance 15 and forced out again at the upper end of the lance 15.

Instead of lances 15, injection nozzles can be provided, their number likewise depending on the furnace diameter.

In order to ensure a uniformly distributed fuel gas stream between the planes of the burners 7 and the grate 4, the individual burners 7 are maintained constantly at the same output by computer control of the air and fuel supply. A computer C connected to the burners 7 is provided to do this.

Cupola furnaces operating without coke of known construction can be used after appropriate conversion for carrying out the invention. The furnace (DUKER) disclosed in the above mentioned DE-A-32 21 241 has proved particularly suitable. While the invention has been illustrated and described as embodied in a method of and apparatus for melting metal in a cokeless cupola furnace, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

1. In a method of melting a metal in a cokeless gas-fired or oil-fired cupola furnace, said furnace including a grate with a bed of refractory bodies arranged on the grate, and a plurality of burners arranged beneath the grate and spaced from the grate to define a space between the grate and the burners, the improvement comprising the step of injecting into the space between the grate and the burners at least one cast iron product quality improving and stabilizing substance as an upwardly directed emerging jet.

2. The improvement as defined in claim 1, wherein said cast iron product quality improving and stabilizing substance is a refining substance.

3. The improvement as defined in claim 1, wherein said cast iron product quality improving and stabilizing substance is a nuclear-enriching substance.

4. The improvement as defined in claim 1, wherein said injecting step includes injection of at least one nitrogen-releasing compound in the space between the grate and the burners.

5. The improvement as defined in claim 1, wherein said injecting step includes injection of at least one organic nitro compound, wherein said organic nitro compound has a nitro group, in the space between the grate and the burners.

6. The improvement as defined in claim 1, wherein said injecting step includes injection of hydrogen compounds of nitrogen in the space between the grate and the burners.

7. The improvement as defined in claim 1, wherein said injecting step includes injection of a nitrogen-containing compound selected from the group consisting of ammonia, hydrazine, ammonia derivatives and hydrazine derivatives in the space between the grate and the burners.

8. The improvement as defined in claim 1, wherein said injecting step includes injection of at least one halogen-containing compound selected from the group consisting of methyl chloride, chlorobenzene and fluorobenzene in the space between the grate and the burners.

9. The improvement as defined in claim 1, wherein said injecting step includes injection of nitrogen-containing and halogen-containing compounds in the space between the grate and the burners.

10. The improvement as defined in claim 1, wherein said injecting step includes injection of monochlorinated and nitrated organic compounds in the space between the grate and the burners.

11. The improvement as defined in claim 1, further comprising the steps of making a solution of one of the cast iron product quality improving and stabilizing substances, said quality improving and stabilizing substances having a tendency to coke when heated, in a coking-preventing solvent selected from the group consisting of cyclohexane, toluene, xylene and chlorinated compounds, said chlorinated compounds being structured to release chlorine at a melt temperature of a melt formed by melting said metal, and wherein said injecting step includes injection of said solution into said space.

12. In a method of melting a metal in a cokeless gas-fired or oil-fired cupola furnace, said cupola furnace including a grate with a bed of refractory bodies arranged thereon, and a plurality of burners arranged beneath the grate, said burners being spaced from said grate to define a space between the burners and the grate, the improvement comprising the step of injecting into the space between the grate and the burners as an upwardly directed emerging jet at least one cast iron product quality improving and stabilizing substance selected from the group consisting of nitrogen-releasing substances including ammonia, hydrazine, ammonia derivatives and hydrazine derivatives.

13. In a method of melting a metal in a cokeless gas-fired or oil-fired cupola furnace, said cupola furnace including a grate with a bed of refractory bodies arranged thereon, and a plurality of burners arranged beneath the grate, said burners being spaced from said grate to define a space between the burners and the grate, the improvement comprising the step of injecting into the space between the grate and the burners as an upwardly directed emerging jet at least one cast iron product quality improving and stabilizing substance selected from the group consisting of halogen-containing substances.

14. A cupola furnace operated without coke, comprising a grate with a bed of refractory bodies arranged thereon; a plurality of burners arranged beneath the grate and spaced therefrom; and means located in a furnace wall between said grate and said burners for injecting into a space defined between said grate and said burners cast product quality improving and stabilizing substances, wherein said injecting means comprises at least one throughgoing guideway in the furnace wall located between the grate and the burners, and at least one lance extending obliquely downward in the guideway into said space, said lance being structured and having an upwardly directed mouth portion, so that said product quality improving and stabilizing substance can be injected in said space through said lance as an upwardly directed emerging jet.

* * * * *

UNITED STATES PATENT AND TRADEMARK OFFICE

CERTIFICATE OF CORRECTION

PATENT NO. : 5,224,985

DATED : July 6, 1993

INVENTOR(S) : Wolfgang Kullik, Rainser Graf, and Alfred Langner

It is certified that error appears in the above-indentified patent and that said Letters Patent is hereby corrected as shown below:

On the Title Page, Item [30], the Foreign Application Priority data is --May 20, 1989 [DE]--.

Signed and Sealed this

Second Day of August, 1994

*Attest:*

Bruce Lehman

BRUCE LEHMAN

*Attesting Officer*

*Commissioner of Patents and Trademarks*